US005389766A

United States Patent [19]

Takahashi et al.

[11] Patent Number: 5,389,766

[45] Date of Patent: Feb. 14, 1995

[54] RAIL SNOW-MELTING BY ELECTROMAGNETIC INDUCTION HEATING

[75] Inventors: Seiichi Takahashi; Ichiro Ideno, both of Tokyo; Kouji Awatani; Hirotsune Kimura, both of Kawasaki, all of Japan

[73] Assignee: Fuji Electric Co., Ltd., Kanagawa, Japan

[21] Appl. No.: 157,267

[22] Filed: Nov. 26, 1993

[30] Foreign Application Priority Data

Nov. 27, 1992 [JP] Japan ..... 4-317657

[51] Int. Cl.[6] ..... H05B 6/10

[52] U.S. Cl. ..... 219/635; 219/639; 219/213; 219/676; 37/199; 104/279; 246/428

[58] Field of Search ..... 219/635, 639, 672, 676, 219/213; 37/199, 200; 104/279, 280; 246/428

[56] References Cited

U.S. PATENT DOCUMENTS 3,410,977 11/1968 Ando ..... 219/635
3,648,017 3/1972 Obata ..... 219/213

FOREIGN PATENT DOCUMENTS 533906 12/1954 France ..... 219/635
669976 4/1952 United Kingdom .

*Primary Examiner*—Philip H. Leung
*Attorney, Agent, or Firm*—Finnegan, Henderson, Farabow, Garrett & Dunner

[57] ABSTRACT

A snow-melting apparatus of an electromagnetic induction heating type, comprises: a high frequency power source; a pair of conductive cables wound in at least one turn around a segment of each rail and through through-holes which are formed through side walls of the rail, the segment of the rail being defined between two through-holes; and a lead wire interconnecting the power source and the conductive cable, for supplying current from the power source to the conductive cable, thereby heating the rail by the flow of electromagnetic ally induced current in the rail segment.

7 Claims, 5 Drawing Sheets

RAIL SNOW-MELTING BY ELECTROMAGNETIC INDUCTION HEATING

BACKGROUND OF THE INVENTION

1. Field of the Invention

The present invention relates to an electromagnetic induction heating snow-melting apparatus for induction-heating rails by electromagnetically induced current supplied from a high frequency power source, thereby eliminating such a situation that rail points are covered by ice and/or snow and thus rendered immovable for switching.

2. Discussion of the Related Art

FIG. 1 is a diagram showing a rail point (switch) included in a railroad track. The rail points are constructed with a pair of basic rails 1 (1R (right) and 1L (left)), a pair of tongue rails 2 (2R and 2L) laying along the basic rails 1, a number of washers 3, and a number of sleepers 4.

The rail points thus constructed, when covered with ice/snow, are frequently inoperable for switching. To cope with this, many types of heating apparatus have been used. Among those heating apparatus, the snow-melting apparatus using electric heaters has predominantly been used. These heaters are used in a state that the heaters are mounted on sleepers or basic rails. Heat generated by the heaters is transmitted to the sleepers or basic rails, thereby melting ice and snow from the rails. In this construction, a relatively large heat quantity, which should be transferred to the rails, is dissipated to the atmosphere. The snow-melting apparatus thus unsatisfactorily functions in the snow-melting performance. Thus, the conventional snow-melting apparatus is not only inefficient but also consumes much electric power.

To solve the disadvantages of the snow-melting apparatus of the heater type, a snow-melting apparatus based on another principle, i.e., electromagnetic induction, that is, a snow-melting apparatus of the electromagnetic induction heating type, has been proposed.

FIG. 2 is a diagram showing the overall construction of the snow-melting apparatus of the electromagnetic induction heating type. FIG. 3 is an enlarged view showing the snow-melting apparatus of FIG. 2. In these figures, reference numeral 1 designates a basic rail; 4, a sleeper; 5, a heating coil; 6, a high frequency power source; and 7, paired lead wires. As shown, heating coils 5 are attached to the outer side walls of the basic rail 1 (heating coils 5 attached to the upper rail 1 in FIG. 2 are indicated by dotted lines because those are disposed on the outside of the rail 1). In operation, the high frequency power source 6 feeds a high frequency current to the heating coils 5 thus attached to the rails 1 by way of the lead wires 7 and cables extending therefrom. At this time, magnetic fluxes B are developed from the heating coil 5 as shown in FIG. 4. Eddy current EC is caused by the magnetic fluxes B to flow in the basic rail 1. As a consequent, the rails 1 are heated internally by the eddy currents. Heat loss occurs only in the high frequency power source 6 and in the heating coils 5. Therefore, the heating efficiency is good with less power consumption. This fact is actually confirmed.

In designing the snow-melting apparatus of the electromagnetic induction heating type, design requirements such as heat resistance, weather proof, durability, vibration-proof, and the like are very strict. Further, a high frequency power source must be used exclusively for this apparatus. The cost to manufacture this apparatus is high. For this reason, the snow-melting apparatus of the electromagnetic induction heating type has been not practically used, while the snow-melting apparatus of the electric heater type is widely used because of stability and low equipment cost, it is poor in heating efficiency.

As described above, it is confirmed that the heating efficiency of the electromagnetic induction heating type is good since the rails 1, in effect, generate heat. The heating coil 5, as usually manufactured, is packaged in a molded case. The heating coil packages are then attached to the rails 1 as shown in FIGS. 2 or 3. Accordingly, it must endure the vibrations of rails 1, be mechanically reliable, and must withstand every weather condition. Further, it must have low cost. The heating coils 5 must be simply and easily attached to the rails 1 at the side irrespective of rail length. Where a plural number of coils 5 are attached to the rails 1 of different lengths, it is difficult to standardize the coil attaching work.

SUMMARY OF THE INVENTION

Accordingly, the present invention has been conducted in view of the above, and an object of the invention is to provide a snow-melting apparatus of the electromagnetic induction heating type in which the heating coils are mechanically reliable, and highly weatherproof, simple in construction, low in cost, and easy to install.

To achieve the above object, according to a first aspect, the present invention provides a snow-melting apparatus of the electromagnetic induction heating type, in which through-holes are formed in the basic rails in the rail points of a railroad track so as to open to the side walls of each rail, conductive cables are wound by one turn around the segment of the rail between the through-holes and through the through-holes, thereby forming heating coils, and a high frequency power source feeds current to the cables, thereby heating the rails by the electromagnet induction, and melting snow and ice on and near the rail points.

According to a second aspect, the present invention provides a snow-melting apparatus of the electromagnetic induction heating type in which through-holes are formed in the tongue rails in the rail points so as to open to the side walls of each rail, conductive cables are wound by one turn around the segment of the rail between the through-holes and through the through-holes, thereby forming heating coils, and a high frequency power source feeds current to the cables, thereby heating the rails by the electromagnet induction, and melting snow and ice on and near the rail points. In the first and second aspects of the invention, the heating coils may be covered with a metal cover, thereby protecting the heating coils against external forces applied thereto, suppressing electromagnetically noise generated noise and reducing leakage of the magnetic flux, to secure improvement in heating efficiency. Further, the frequency of the high frequency power source may be selected so as to little affect on communication links with passing trains, automatic train stopping devices, and crossing controllers.

Thus, in the snow-melting apparatus of the electromagnetic induction heating type, through-holes are formed in the basic or tongue rails so as to open to the side walls of each rail, conductive cables are wound around the segment of the rail between the through-holes and through the through-holes, thereby forming heating coils, and a high frequency current is fed to the heating coils. Therefore, the construction of the apparatus is simple, and the coil mounting work at the site is easy.

BRIEF DESCRIPTION OF THE DRAWINGS

The accompanying drawings, which are incorporated in and constitute a part of this specification, illustrate embodiments of the invention and, together with the description, serve to explain the objects, advantages and principles of the invention. In the drawings.

DETAILED DESCRIPTION OF THE PREFERRED EMBODIMENTS

Figure 1:
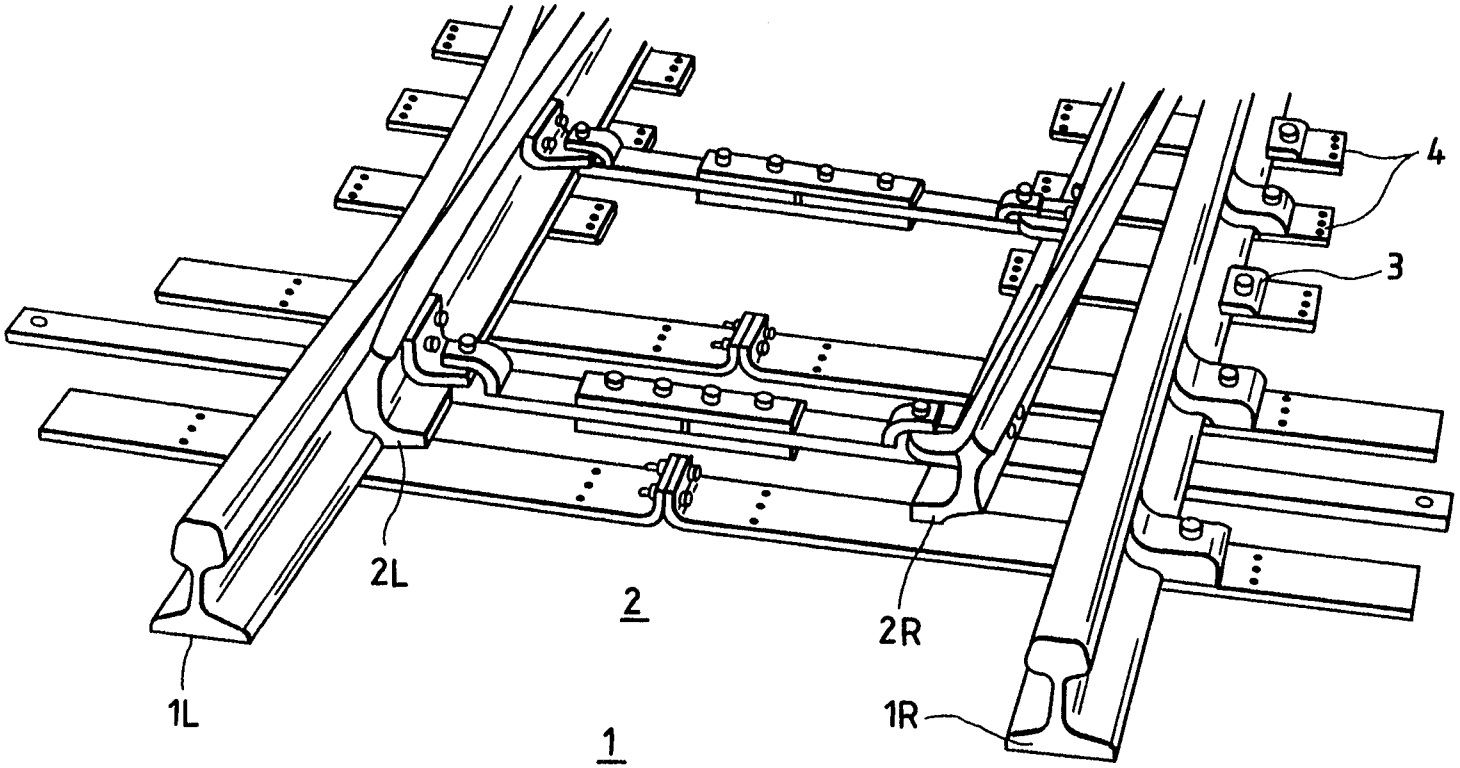
FIG. 1 PRIOR ART
FIG. 1 is a diagram showing general rail points of a railroad.
Figure 2:
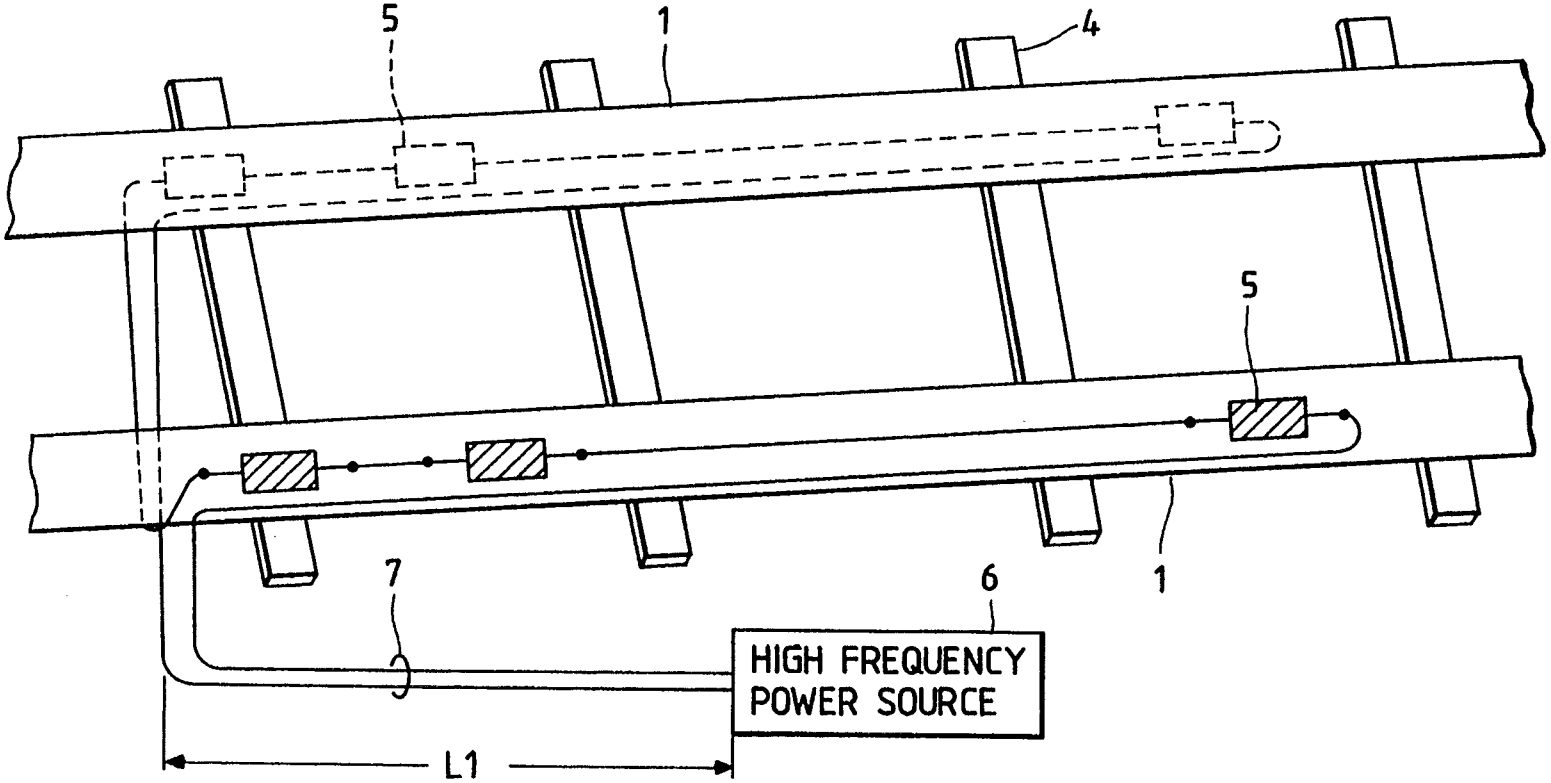
FIG. 2 PRIOR ART
FIG. 2 is a diagram showing the overall construction of a conventional snow-melting apparatus of the electromagnetic induction heating type.
Figure 3:
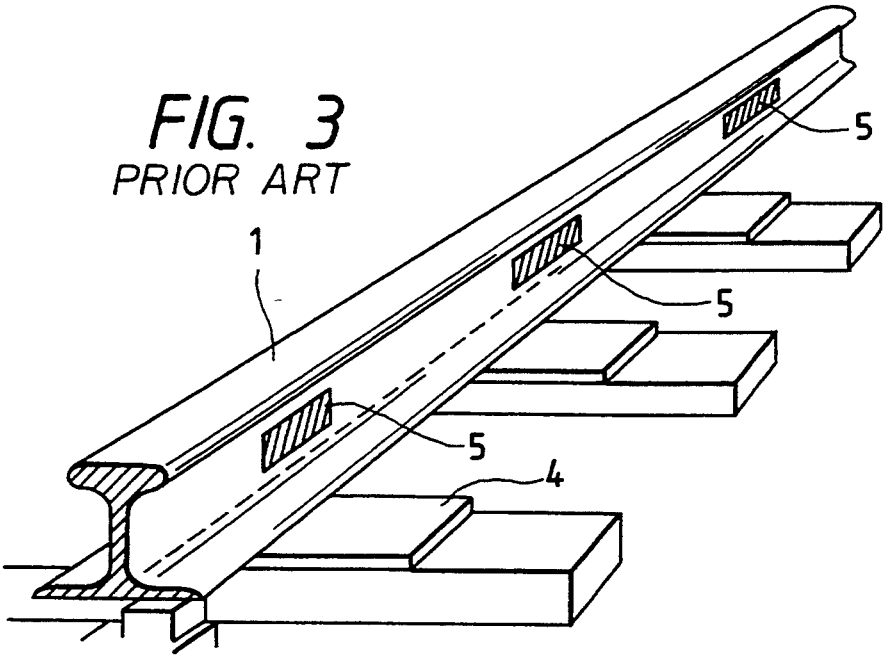
FIG. 3 PRIOR ART
FIG. 3 is an enlarged view showing the snow-melting apparatus of FIG. 2.
Figure 4:
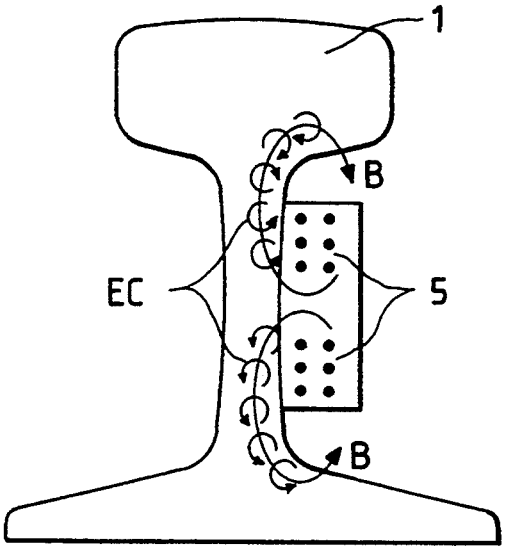
FIG. 4 PRIOR ART
FIG. 4 is an explanatory diagram showing the principle of an electromagnetic induction heating apparatus.
Figure 5:
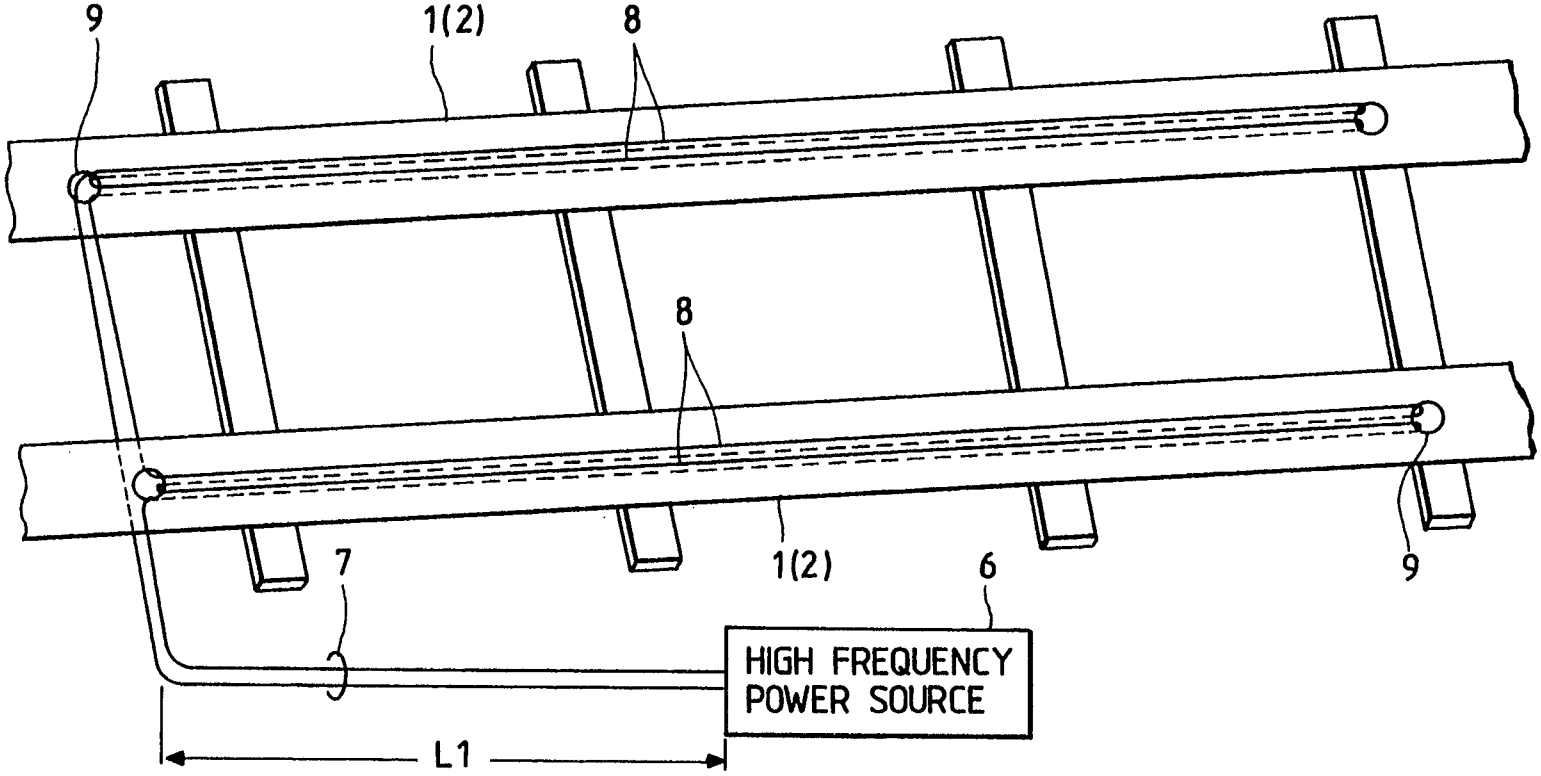
FIG. 5 is a diagram showing the overall construction of a snow-melting system of an electromagnetic induction type according to an embodiment of the present invention.
Figure 6:
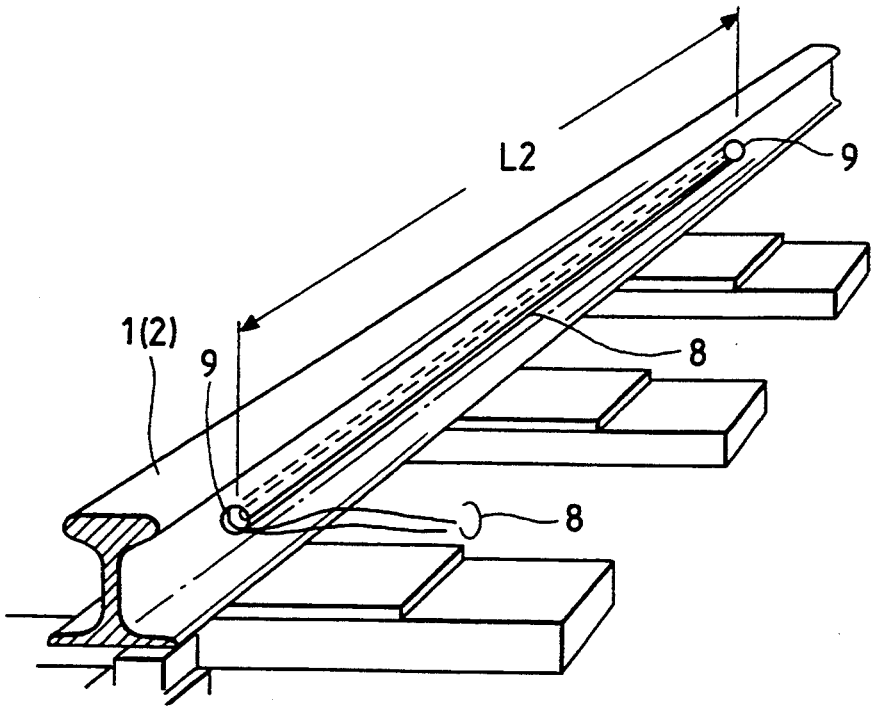
FIG. 6 is an enlarged view showing the snow-melting apparatus of FIG. 5.

FIG. 5 is a diagram showing the overall construction of a snow-melting apparatus of the electromagnetic induction heating type according to an embodiment of the present invention. FIG. 6 is an enlarged view showing the snow-melting apparatus of FIG. 5.

As shown, through-holes 9 are opened in the side walls of the basic rail 1. Conductive cables 8 are wound a necessary number of turns (two turns in FIGS. 5 and 6) around the segment of the basic rail 1 that ranges between two through-holes 9. The number of turns of the cables 8 is properly determined in consideration of an operating frequency of a high frequency power source 6 and impedance matching. Reference numeral 7 designates paired lead wires connecting a high frequency power source 6 to conductive cables 8. The paired lead wires 7 may be made of the same material as the conductive cables 8 or different material. In either case, the inductance of the wires must be properly selected since a high frequency current passes therethrough. Use of flexible lead wires 7 ensures a reliable connection of the conductive cables 8 to the basic rails 1. To standardize the apparatus mounting work on the site, it is preferable to previously select the length L1 of the paired lead wires 7 shown in FIG. 5, pitch L2 of the through-holes 9 shown in FIG. 6, the number of turns of the conductive cables 8.

Figure 7:
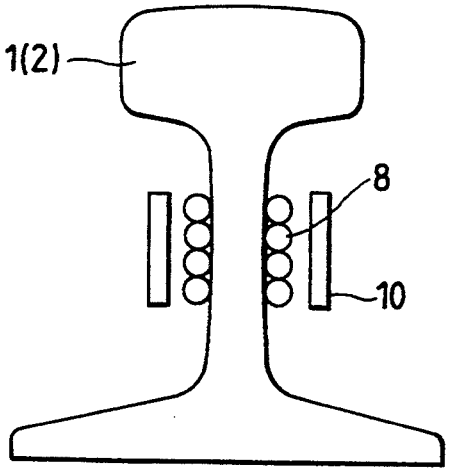
FIG. 7 is a cross sectional view showing a rail with a snow-melting apparatus mounted thereon according to a modification of the present invention.

FIG. 7 is a cross sectional view showing a rail with a snow-melting apparatus mounted thereon according to a modification of the present invention. As seen from the figure, the conductive cables 8 are covered with a metal cover 10. The cover 10 protects the cables 8 from external forces suppress electromagnetically generated electrical noise the magnetic flux developed by the cables 8 are confined within the metal cover 10. The basic rails 1 and the cover 10 can be efficiently heated. It is almost impossible to completely suppress electromagnetically noise. Therefore, the operating frequency of the high frequency power source 6 is selected so that the noise does not affect communication links, ATS (automatic train stopping) device, crossing controllers in the train, etc.

Excessive heating of the rails must be avoided. Rail temperature must be properly adjusted according to ambient temperature, snowfall state, and frozen state. To realize this, sensors for sensing rail temperatures and a controller are provided. The controller controls the snow-melting apparatus mounted on rails 1 according to sensed rail temperature values so that rail temperature is kept at a preset temperature value. With such an organization, the rail-freezing prevention can be performed effectively.

The heater or heating coils are generally mounted on the basic rails, because vibration, impact, and the like of the tongue rails 2 make it difficult to secure stable and reliable mounting of the heating coils on the tongue rails 2. When the heating coils are unstably and unreliably mounted, they may be damaged, loosened, fall off or the like. It is noted here that in the present invention, the heating coils are wound around the segments of the rails 1 between the through-holes 9 and through the through-holes. In other words, even if the heating coils are mounted on the tongue rails 2 according to the invention, the mounted coils are stable against the vibration, impact, and the like. Therefore, the snow-melting apparatus of the electromagnetic induction heating type according to the present invention may likewise be applied to the tongue rails 2, in lieu of the basic rails 1 shown in FIGS. 5 to 7.

As described above, in the present invention, cables are wound around a specific segment between through-holes opened in the side walls of each rail and through the through-holes. Accordingly, specially designed heating coils are not required. The snow-melting apparatus of the invention, when mounted on the rails is more efficiently operable and inexpensive as with less power consumption, compared with the snow-melting apparatus of the electric heating type. Further, it is more durable, and vibration-proof, and the heating coils can be easily and simply installed on the rails.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An apparatus of an electromagnetic induction heating type for melting snow from rails of a railroad track, comprising:

a power source;

an electrically conductive cable wound in at least one turn around a segment of a rail and through spaced through-holes formed in said rail, the segment of said rail being defined between two of said through-holes; and a lead wire interconnecting said power source and said conductive cable for supplying electric current from said power source to said conductive cable to heat the rail segment by electromagnetic induction and melt snow therefrom.

2. A snow-melting apparatus according to claim 1, wherein said through-holes are formed through side walls of said rail.

3. A snow-melting apparatus according to claim 1, wherein said through-holes are formed in a tongue rail included in in a rail point of the railroad track.

4. A snow-melting apparatus according to claim 1, further comprising a metal cover for covering said conductive cable.

5. A snow-melting apparatus according to claim 1, wherein said power source comprises a high frequency power source.

6. A snow-melting apparatus according to claim 5, wherein the frequency of said high frequency power source is selected to avoid signal interference with communication links of passing trains, automatic train stopping devices, and crossing controllers.

7. A snow-melting apparatus according to claim 1, further comprising means for detecting a temperature of said rail, and means for adjusting the detected temperature of said rail to a predetermined value.

* * * * *

UNITED STATES PATENT AND TRADEMARK OFFICE

CERTIFICATE OF CORRECTION

PATENT NO. : 5,389,766

DATED : February 14, 1995

INVENTOR(S) : Seiichi TAKAHASHI et al

It is certified that error appears in the above-indentified patent and that said Letters Patent is hereby corrected as shown below:

Abstract, Front Page, Line 11, "electromagnetic" should read --electromagnetic - --.

Claim 3, Column 5, Line 16, delete "in" (second occurrence).

Signed and Sealed this

Twentieth Day of June, 1995

Bruce Lehman

*Attest:*

BRUCE LEHMAN

*Attesting Officer*

*Commissioner of Patents and Trademarks*